US005521627A

United States Patent [19]

Keung et al.

[11] Patent Number: 5,521,627

[45] Date of Patent: May 28, 1996

[54] THERMAL PRINTER

[75] Inventors: Wing-Kwong Keung, Wilton; Walter J. Kulpa, Trumbull, both of Conn.

[73] Assignee: Pitney Bowes Inc., Stamford, Conn.

[21] Appl. No.: 331,304

[22] Filed: Oct. 28, 1994

[51] Int. Cl.[6] ..... B41J 11/14

[52] U.S. Cl. ..... 347/220; 347/218; 400/652; 400/648; 400/649

[58] Field of Search ..... 347/171, 215, 347/218, 220; 346/134; 400/652, 648, 649

[56] References Cited

U.S. PATENT DOCUMENTS

| | | | |
|---|---|---|---|
| 5,085,533 | 2/1992 | Kitahara et al. | 400/652 |
| 5,339,280 | 8/1994 | Goldberg et al. | 346/134 |

*Primary Examiner*—Huan H. Tran
*Attorney, Agent, or Firm*—Angelo N. Chaclas; Charles G. Parks, Jr.; Melvin J. Scolnick

[57] ABSTRACT

An improved thermal printing apparatus having a frame for supporting an elongate thermal print head extending opposite to an elongate print roller. The thermal print head being responsive to a microcontroller for printing on an article positioned between the thermal print head and the print roller. The improvement comprises: a drive housing pivotally mounted to the frame, the print roller rotatively mounted to the drive housing, an eject roller rotatively mounted to the drive housing parallel to the print roller, backing means located opposite the eject roller, means responsive to said microcontroller for causing said drive housing to pivotally displace to a first position biasing the print roller in the direction of the thermal print head and against the article for printing, and for causing the drive housing to pivotally displace to a second position biasing the eject roller in the direction of the backing means and against the article when the microcontroller has completed printing. The thermal printing apparatus further comprising compensation means for causing the print roller to displace perpendicular to the thermal print head in response to the thickness of said article while maintaining the biasing force on the article.

7 Claims, 9 Drawing Sheets

THERMAL PRINTER

BACKGROUND OF THE INVENTION

The present invention relates to a thermal printer containing a thermal print head. More particularly, the invention relates to heat-transfer thermal printer in which articles and a thermal ink ribbon are caused to simultaneously traverse the thermal print head which selectively heats the ink ribbon to transfer ink to the article in a predetermined pattern. The articles may be any sheet-like material such as paper, film, etc. while the pattern may be a bar code, postal indicia, series of alphanumeric characters or other desired image.

In situations where printing occurs along the entire article, printer throughput is limited by the speed at which the thermal print head operates. However, if printing occurs only on a portion of the article, then printer throughput is also influenced by the speed at which the article can be feed through the printer when there is no printing taking place. Postage meters are an example where printing occurs only on a portion of the article. Typically, a postal indicia occupies only a small portion of the surface of an envelope. Other printing applications, such as: lottery tickets, point of sale consumer receipts, merchandise identification tags or labels, etc., may be similarly situated.

It is well know in the mailing industry to print a postal indicia on an envelope using a postage meter. Postage meters may utilize a variety of technologies to perform the printing process. Traditional postage meters use a rotary die that includes an embossed postal indicia. After applying ink to the die, the die is rotated to engage an envelope and transfer the postal indicia to the envelope. Other postage meters use thermal printing technology to create the postal indicia image on the envelope. In thermal postage meters, the envelope is compressed against a thermal print head by a print or platen roller with a thermal ink ribbon captured there between. To print the postal indicia, the envelope and ink ribbon are simultaneously advanced past the thermal print head while the individual thermal print head elements are selectively heated causing the ink to liquify and transfer to the envelope. Once printing is completed, it is necessary to feed the envelope from the postage meter.

Of particular interest is the thermal postage meter described in detail in U.S. Pat. No. 5,339,280 (C-907), assigned to the assignee of the present invention and incorporated herein by reference. The thermal postage meter described above differs from other thermal printers primarily in that it provides both a print roller and an eject roller for independent control of the envelope which allows for increased throughput without wasting thermal ink ribbon. However, it has been empirically determined that the above referenced thermal postage exhibited numerous problems, some of which are high motor torque requirements and high manufacturing cost.

It is important that the print roller supply adequate force to ensure proper ink transfer from the ribbon to the envelope, but not excessive force which could damage the thermal print head.

It is also important not to smudge the indicia printed on the envelope when feeding the envelope from the postage meter.

SUMMARY OF THE INVENTION

It is an object of the present invention to present a thermal printer that overcomes the disadvantages as demonstrated by the prior art system.

It is another object of the present invention to present a thermal printer that is suited to provide the ability to feed a printed article at a selectable speed which may differ from the required printing speed.

Upon proper positioning of an envelope on the deck of the thermal postage meter, a leading edge sensor detects the presence of the envelope. As a result, a microcontroller initiates a print sequence. A drive housing which includes a print roller and an eject roller is repositioned by a crank assembly from a home position to a print position where the print roller compresses the envelope and an ink ribbon against a thermal print head. The microcontroller instructs a motor controller to cause a drive motor to rotate the print roller. Rotation of the print roller causes the envelope and the ink ribbon to traverse the thermal print head in relative relationship to each other. While the envelope and ink ribbon traverse the thermal print head, the microcontroller simultaneously instructs a thermal print head controller to enable the thermal print head to print a postal indicia on the envelope. Following completion of the printing, rotation of the print roller ceases and the crank assembly repositions the drive housing from the print position to an eject position where the eject roller compresses the envelope against a backing roller. Unlike in the print position, the ink ribbon is not positioned in-between the envelope and the backing roller. The drive motor is now again activated to rotate the eject roller and feed the envelope from the thermal postage meter. In this manner, ink ribbon is not wasted when feeding the envelope out from the postage meter. When the trailing edge sensor detects the end of the envelope, the microcontroller instructs the motor controller to turn off the drive motor after a predetermined amount of time and then engage the crank assembly to return the drive housing to the home position where both the print roller and the eject roller are positioned below the deck.

The drive housing is a generally U-shaped frame which is rotatively mounted to a drive shaft extending between the registration wall and a recess in the deck. The axis of the drive shaft is transverse to the direction of envelope travel. The print roller and eject roller are rotatively mounted on opposite ends of the drive housing approximately equal distances from and parallel to the drive shaft. This arrangement provides for a seesaw type of motion pivoting about the drive shaft where motor torque requirements are greatly reduced. A print roller gear train and an eject roller gear train connect the print roller and the eject roller, respectively, to the drive motor through the drive shaft. Generally contained inside the drive housing and rotatively mounted to the drive shaft are a print torsion spring, eject torsion spring, print lever and eject lever.

The crank assembly is operatively connected to the print lever and the eject lever for repositioning the drive housing between the home, print and eject positions. The crank assembly includes a crank motor, a series of gears and shafts leading to a crank arm and a crank roller which engages either the print lever or eject lever to reposition the drive housing.

Additional objects and advantages of the invention will be set forth in the description which follows, and in part will be obvious from the description, or may be learned by practice of the invention. The objects and advantages of the invention may be realized and obtained by means of the instrumentality and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
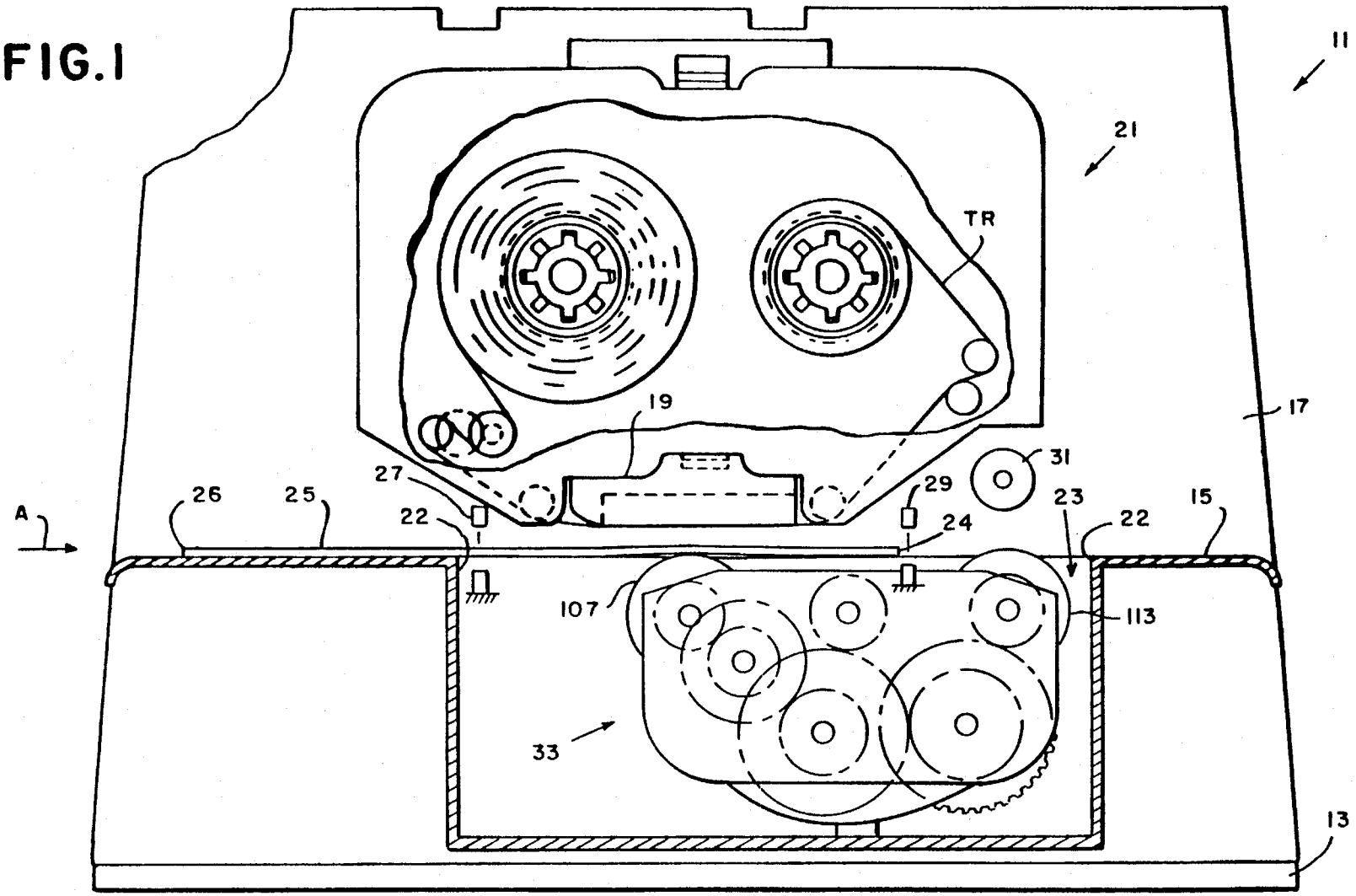
FIG. 1 is a partial sectioned front view of a thermal postage meter and ribbon cassette.

Referring to FIG. 1, a thermal postage meter 11 includes a base 13. Fixably mounted to the base 13 is a substantially vertical registration wall 17. The registration wall 17 and the base 13 each provide suitable framework for mounting and supporting various other components. Fixably mounted to the registration wall 17 and the base 13 is a substantially horizontal deck 15. A thermal print head 19, a trailing edge sensor 27 and a leading edge sensor 29 are fixably mounted to the registration wall 17. Detachably mounted to the registration wall 17 is a thermal ribbon cassette 21 which contains a supply of thermal ink ribbon TR. The operation of the thermal ribbon cassette 21, including the thermal ribbon TR, is disclosed in detail in U.S. Pat. Nos. 5,325,114 (C-912) and 5,300,953 (C-915), both assigned to the assignee of the present invention and specifically incorporated herein by reference. Rotatively mounted to the registration wall 17 is a backing roller 31. An envelope 25 is shown positioned on the deck 15 and travels in the direction indicated by arrow "A." The deck 15 includes an opening 22 and deck recess 23 which are generally aligned underneath the thermal print head 19 and the backing roller 31.

In the preferred embodiment, the registration wall 17 is tipped back 10 degrees from vertical while the deck 15 is likewise inclined 10 degrees from horizontal. Thus, the registration wall 17 and the deck 15 remain perpendicular. The result is that gravity assists the envelope 25 when placed on the deck 15 to align itself against the registration wall 17.

A print and eject roller drive assembly 33 is generally located in the deck recess 23 such that a print roller 107 is opposite the thermal print head 19 and an eject roller 113 is opposite the backing roller 31. The deck recess 23 being sufficiently large to accommodate the drive assembly 33. The combination of the print roller 107 and the thermal print head 19 is commonly referred to as a print station where the actual printing of an indicia on the envelope 25 occurs. The axes of the print roller 107 and eject roller 113 are substantially parallel and transverse to the direction of envelope travel "A." Because the envelope 25 may contain enclosures which result in an uneven thickness near the edges of the envelope 25, it is important that the print roller 107 is of a resilient material and preferably segmented to provide consistent print quality. Various such rollers are available from Globe Manufacturing, Inc.

Figure 2:
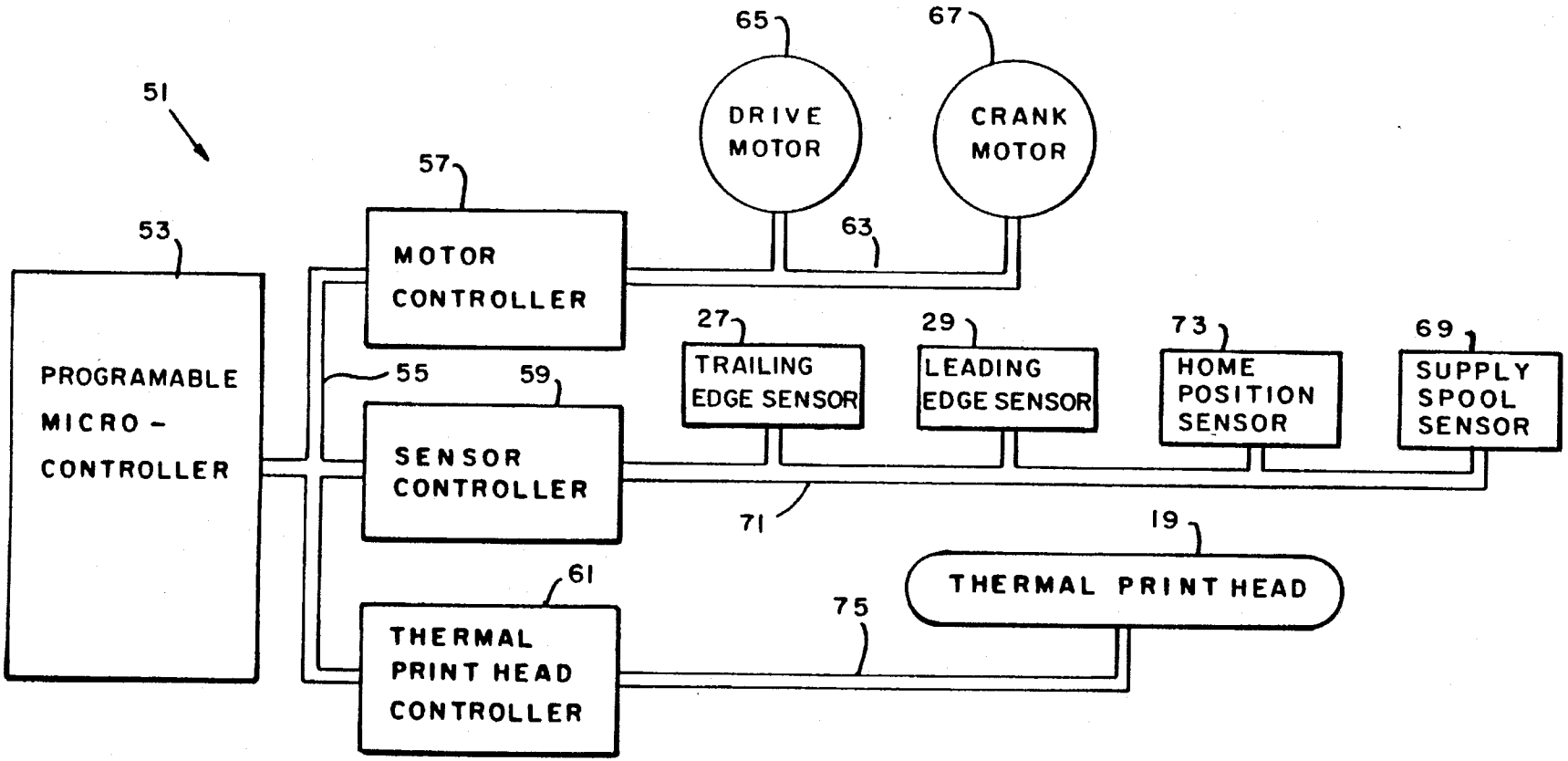
FIG. 2 is a schematic of a microcontroller in accordance with the present invention.

Referring to FIGS. 1 and 2, the thermal postage meter 11 is under the influence of a control system 51. The control system 51 includes a programmable microcontroller 53 of any suitable conventional design, which is in bus 55 communication with: a motor controller 57, a sensor controller 59 and a thermal print head controller 61. The motor controller 57, sensor controller 59, and thermal print head controller 61 are of any suitable conventional design. The motor controller 57 is in motor bus 63 communication with: a drive motor 65 and a crank motor 67. The sensor controller 59 is in sensor bus 71 communication with: the trailing edge sensor 27, the leading edge sensor 29, a home position sensor 73, and a supply spool sensor 69. The trailing edge sensor 27, leading edge sensor 29, home position sensor 73 and supply spool sensor 69 are suitably designed optical sensors. The thermal print head controller 61 is in thermal print head bus 75 communication with the thermal print head 19.

Figure 1A:
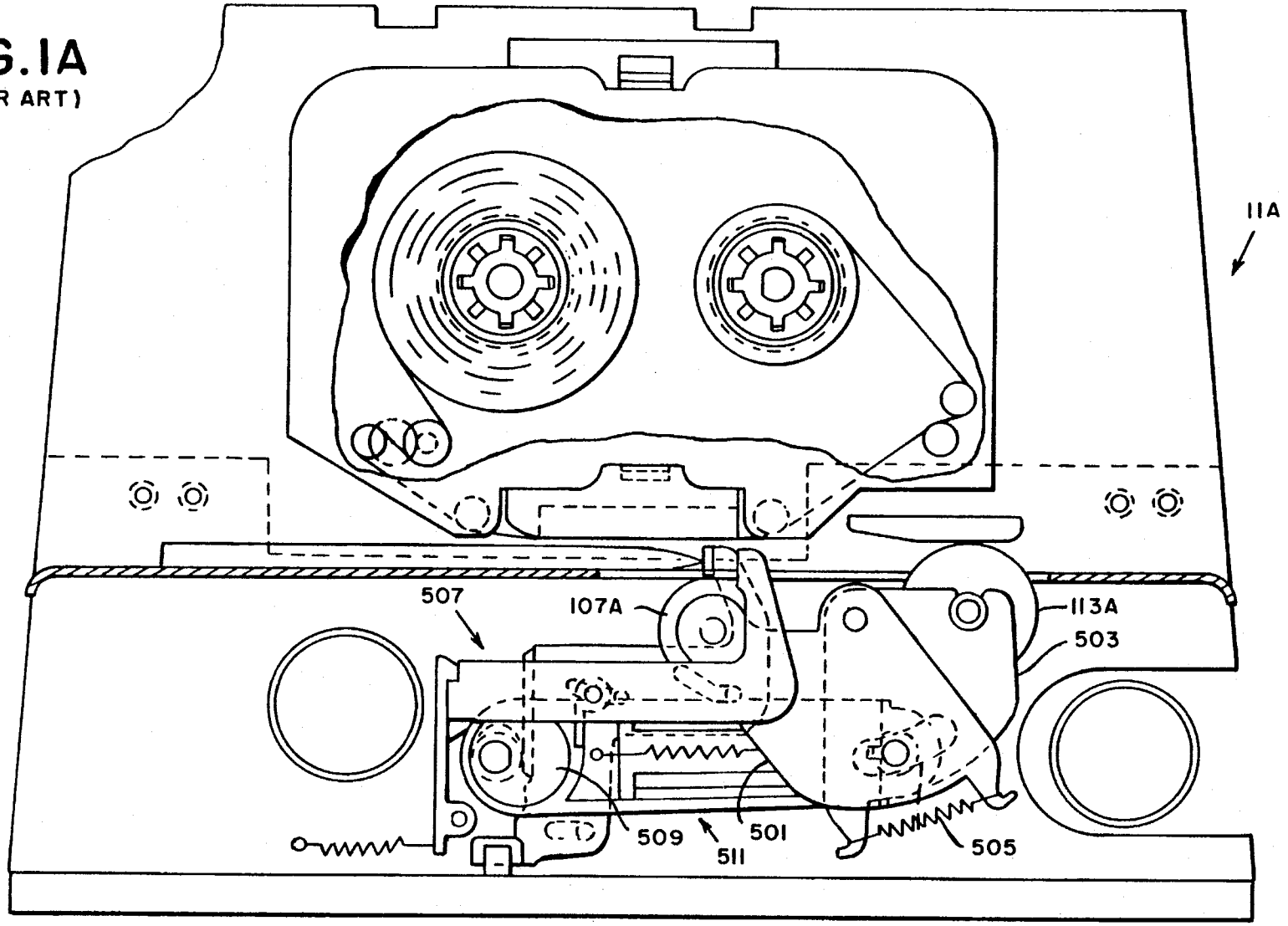
FIG. 1A (PRIOR ART)
FIG. 1A is a partial sectioned front view of a prior art thermal postage meter and ribbon cassette.

Referring to FIG. 1A, a prior art thermal postage meter 11A is shown where a print roller 107A is rotatively mounted to a print roller link 501 and an eject roller 113A is rotatively mounted to an eject roller link 503. Because the print roller 107A and the eject roller 113A are mounted to different links, they may move relative to each other. Also shown is a pivot assembly 507 located remotely from the print roller 107A and eject roller 113A which rotates an eccentric cam 509 which in turn actuates a linkage assembly 511 to reposition the print roller link 501 and the eject roller link 503. Links 501 and 503 are pivotally mounted to shaft 101A is a scissors-like fashion as controlled by spring 505 and assembly 507.

Figure 3:
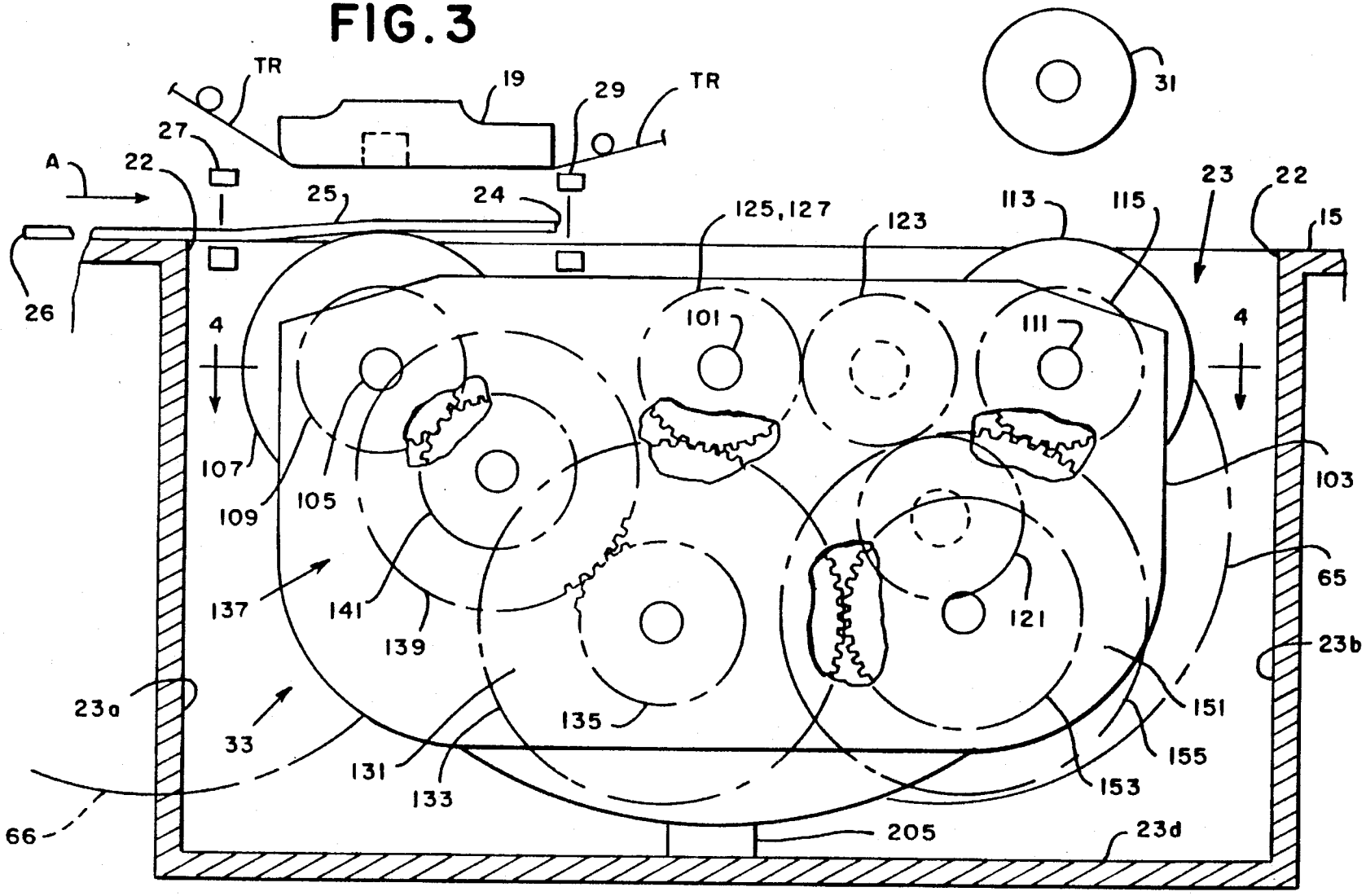
FIG. 3 is a sectioned front view of the drive assembly in the home position.
Figure 4:
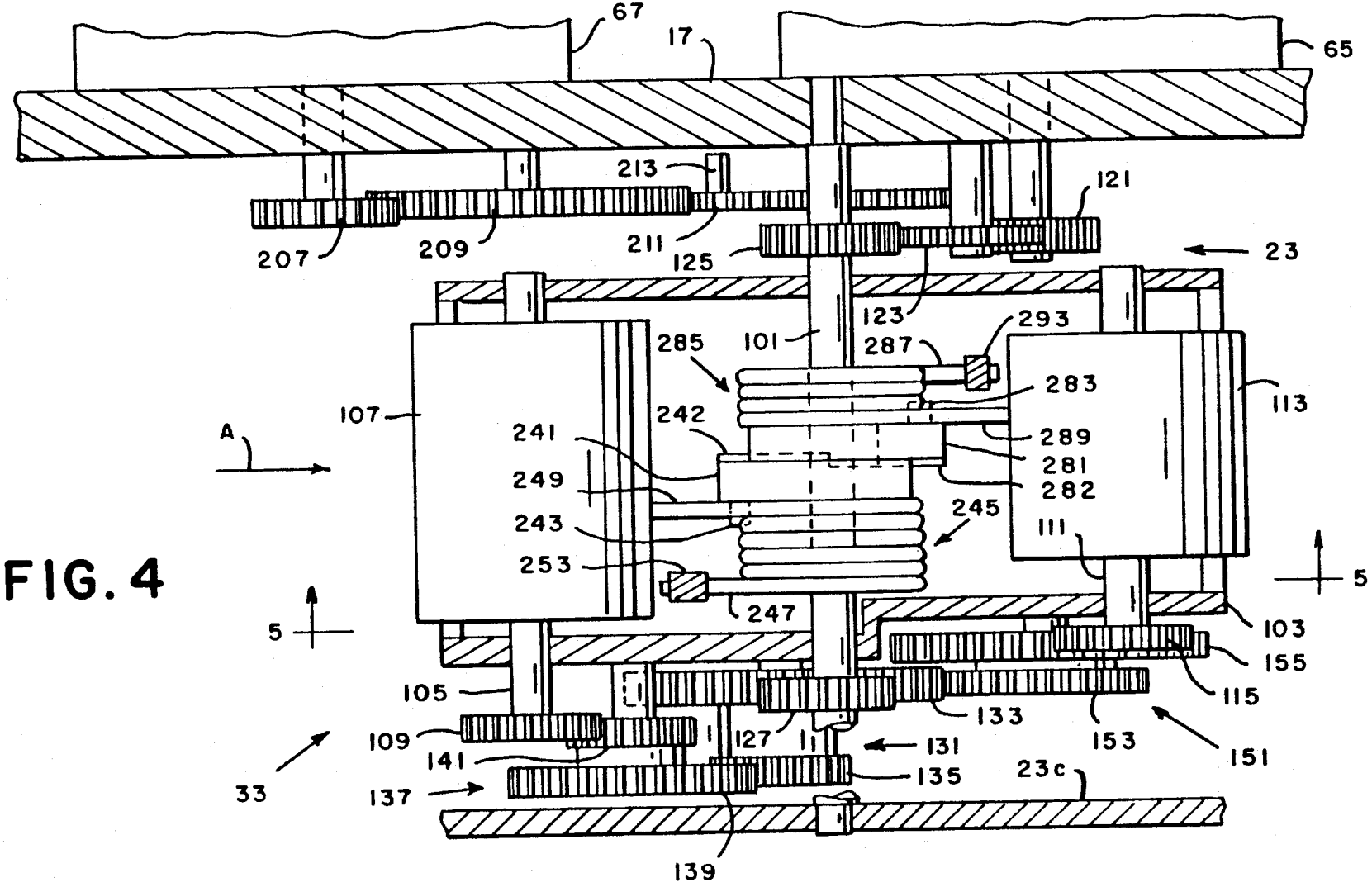
FIG. 4 is a sectioned plane view of the drive assembly taken substantially along 4—4 as shown in FIG. 3.

Referring to FIGS. 3 and 4, the deck recess 23 is a pocket-like depression in the deck 15 formed by vertical walls 23*a*, 23*b* and 23*c* and a horizontal wall 23*d*. The walls 23*a*, 23*b* and 23*c* extend vertically below the deck 15 from the edges of the opening 22. Walls 23*a* and 23*b* are substantially transverse to the direction of envelope 25 travel "A". Wall 23*c* is generally aligned in the direction of envelope 25 travel "A" and substantially parallel to registration wall 17 while extending between walls 23*a* and 23*b*. Walls 23*a*, 23*b* and 23*c* terminate at wall 23*d* which is substantially parallel to and below the deck 15.

Referring to FIG. 3, the drive assembly 33 includes a drive shaft 101 which is rotatively mounted to extend between the registration wall 17 and wall 23*c* of the deck recess 23. The drive shaft 101 is located below and parallel to the deck 15. Additionally, the drive shaft 101 is aligned to be transverse to the direction of envelope travel "A." Rotatively mounted to the drive shaft 101 is a drive housing 103 which is a generally U-shaped bracket with suitable framework for attaching various shafts, springs and gears. The deck recess 23 is sufficiently large and free from obstructions to allow the drive housing 103 to rotate or pivot freely about the drive shaft 101. Rotatively mounted to the drive housing 103 is a print roller shaft 105 and an eject roller shaft 111. Fixably mounted to the print roller shaft 105 is the print roller 107 and a print roller gear 109. Fixably mounted to the eject roller shaft 111 is the eject roller 113 and an eject roller gear 115. As shown in FIG. 3, the print roller 107 and the eject roller 113 are positioned symmetrically about a vertical center line passing through the center of the drive shaft 101. Additionally, the drive shaft 101, the print roller shaft 105 and the eject roller shaft 111 are substantially in horizontal alignment. It should now be apparent that drive housing 103 behaves in a seesaw like fashion pivoting about the drive shaft 101 with the print roller 107 on one end of the drive housing 103 and the eject roller 113 on the other end of the drive housing 103.

Referring to FIGS. 2, 5A, 5B, and 5C, the function of the thermal postage meter 11 is to accept the envelope 25, print an indicia using thermal transfer print technology, and eject the envelope 25 from the meter 11. The feed direction of the meter 11 is from left to right and is indicated by arrow "A". The envelope 25 and thermal ribbon TR are pinched between the print roller 107 and the thermal print head 19. The print roller 107 supplies the thermal print head 19 sufficient backing pressure needed for transfer of ink from a thermal ribbon TR to the envelope 25 during the print cycle. Due to frictional forces, rotation of the print roller 107 causes the envelope 25 and the thermal ribbon TR to feed together at a constant rate past the thermal print head 19. The programmable microcontroller 53 is programmed to instruct the thermal print head controller 61 to actuate the heating elements of the thermal print head 19 synchronous to displacement of the envelope 25 to produce a postal indicia or other desired image. Since the print roller 107 feeds both the envelope 25 and thermal ribbon TR, use of the print roller 107 to feed the envelope 25 from the postage meter 11 would lead to wasted thermal ribbon TR. To conserve thermal ribbon TR, the eject roller 113 is used to feed the envelope 25 out of the postage meter 11 after printing.

Figure 5A:
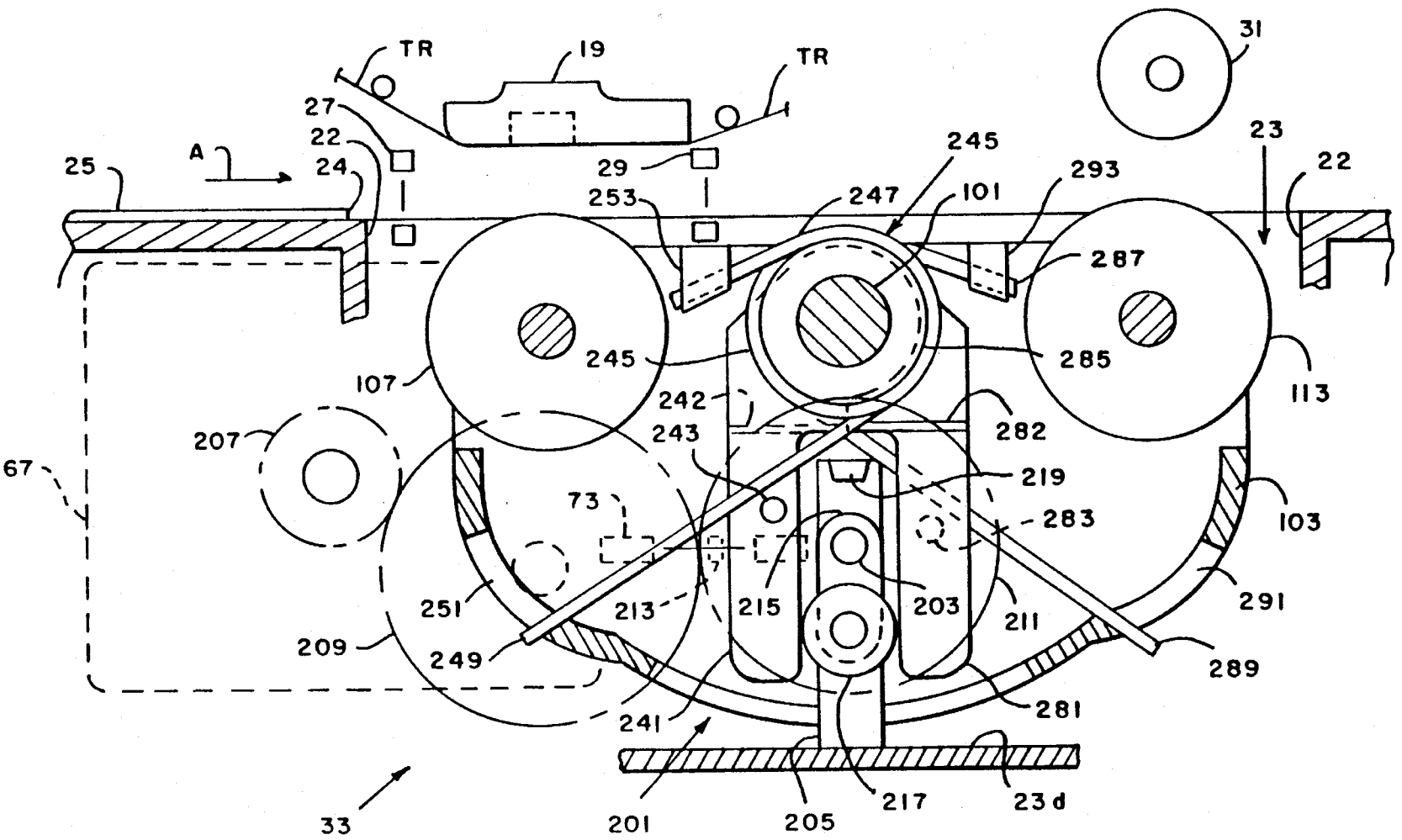
FIG. 5A is a sectioned front view of the drive assembly and crank assembly in the home position taken substantially along 5—5 as shown in FIG. 4.

Referring to FIGS. 5A, the drive assembly 33 is in the home position. The print roller 107 and the eject roller 113 are provided for independent control of the envelope 25. The print roller 107 and eject roller 113 are mounted on opposite sides of the drive housing 103 which pivots about the drive shaft 101. When the drive assembly 33 is in the home position, the print roller 107 is spaced apart from the thermal print head 19 and the eject roller 113 is spaced apart from the backing roller 31. It should be apparent that the feed path of the thermal ribbon TR is defined so that the thermal ribbon TR contacts the thermal print head 19 but not the backing roller 31.

Figure 5B:
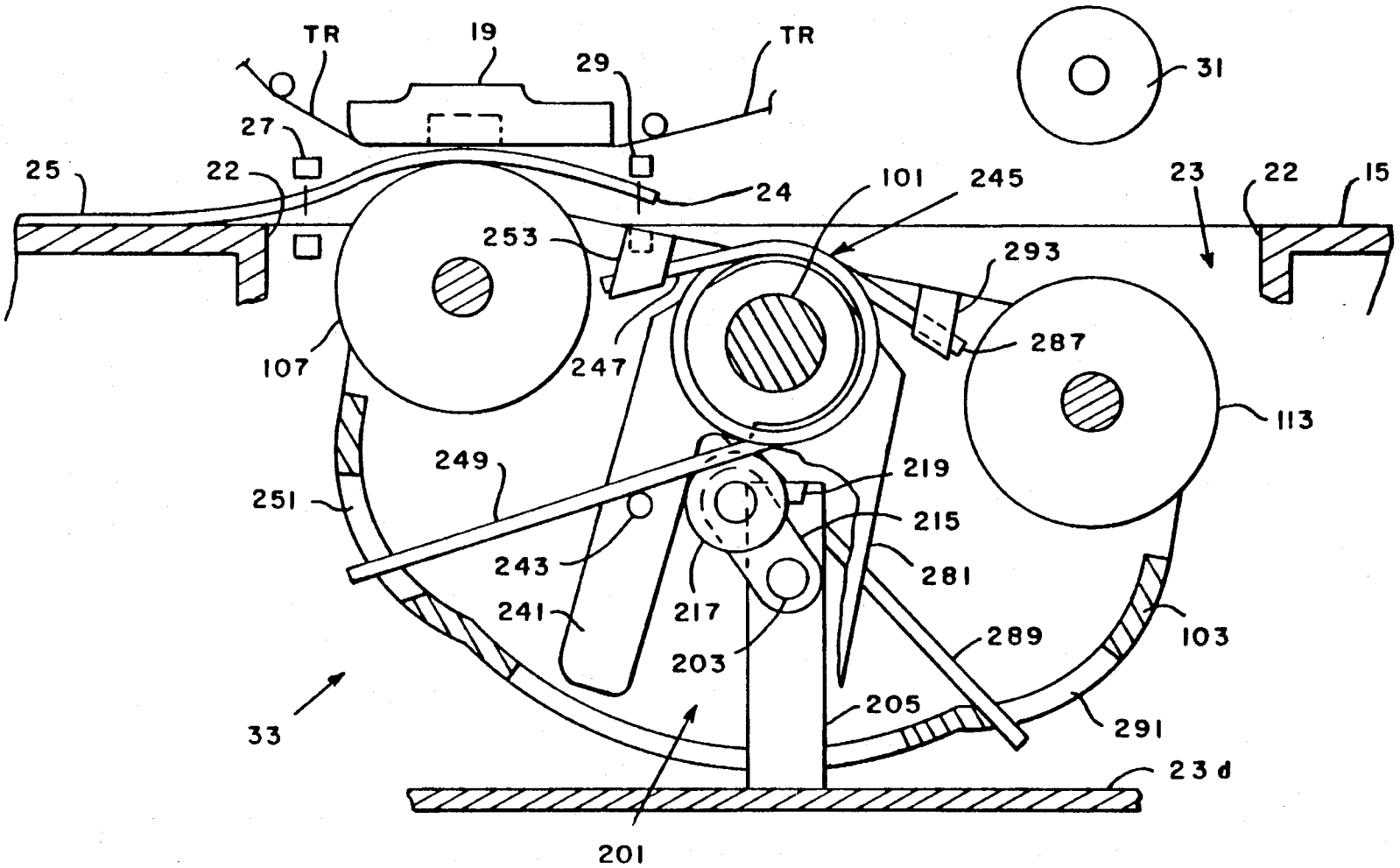
FIG. 5B is a sectioned front view as in FIG. 5A of the drive assembly and the crank assembly in the print position with the eject lever partially broken away for clarity.

Referring to FIGS. 5B, the drive assembly 33 is in the print position. If the drive housing 103 pivots about the drive shah 101 in a clockwise direction from the home position, then the print roller 107 rotates up above the deck 15 to bring the envelope 25 in contact with the thermal ribbon TR and the thermal print head 19. It should be readily apparent that the deck 15 is provided with suitable located openings to accommodate the motion of the drive housing 103 and print roller 107.

Figure 5C:
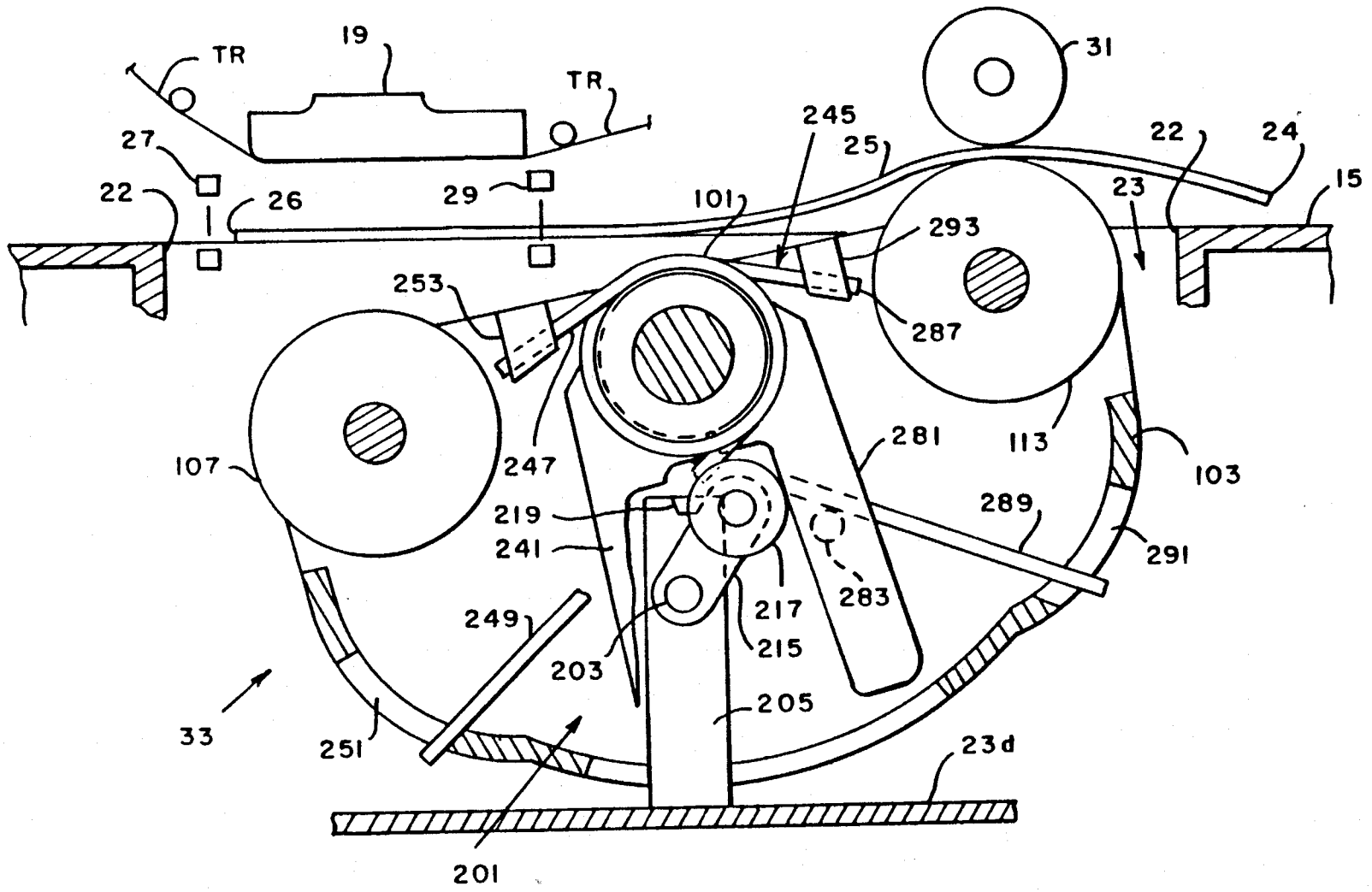
FIG. 5C is a sectioned front view as in FIG. 5A of the drive assembly and the crank assembly in the eject position with the print lever partially broken away for clarity.

Referring to FIG. 5C, the drive assembly 33 is in the eject position. If the drive housing 103 pivots about the drive shaft 101 in a counter clockwise direction from the home position, then the eject roller 113 rotates up above the deck 15 to bring the envelope 25 in contact with the backing roller 31. It should be readily apparent that the deck 15 is provided with suitable located openings to accommodate the motion of the drive housing 103 and eject roller 113.

The drive assembly 33 also includes all those components concerned with actuating the print roller 107 and the eject roller 113. Referring to FIGS. 3 and 4, the source of power in the drive assembly 33 is the drive motor 65 which is fixably mounted to the registration wall 17. Fixably mounted to the output shaft of the drive motor 65 is a drive motor output gear 121. In constant mesh with the drive motor output gear 121 is an idler gear 123 which is rotatively mounted to the registration wall 17. Fixably mounted to one end of the drive shaft 101 is a first drive shaft gear 125 which is in constant mesh with the idler gear 123. Fixably mounted to the other end of the drive shaft 101 is a second drive shaft gear 127. Rotatively mounted to the drive housing 103 is a first gear cluster 131. As used herein, gear cluster is a term of art that refers to a plurality of co-axial gears that rotate together in a synchronous fashion. The first gear cluster 131 includes a gear 133 and a gear 135. The gear 133 is in constant mesh with the second drive shaft gear 127. Therefore, as the second drive shaft gear 127 causes the gear 133 to rotate, the gear 135 rotates as well. Also rotatively mounted to the drive housing 103 is a second gear cluster 137 which includes a gear 139 and a gear 141. The gear 139 is in constant mesh with the gear 135 of the first gear cluster 131. Accordingly, as the gear 139 rotates, the gear 141 rotates as well. Gear 141 is in constant mesh with the print roller gear 109 so as to cause rotation of the print roller 107. This completes a series of interconnecting gears from the drive motor 65 to the print roller 107 commonly referred to as a print roller gear train. Therefore, the drive motor 65 causes rotation of the print roller 107 at a desired speed by way of the print roller gear train.

Further, a third gear cluster 151 is also rotatively mounted to the drive housing 103. The third gear cluster 151 includes a gear 153 and a gear 155. The gear 153 is in constant mesh with the gear 133 of the first gear cluster 131. Therefore, it is now apparent to those skilled in the art that the first gear cluster 131 simultaneously drives both the second gear cluster 137 and the third gear cluster 151. As the gear 153 rotates, the gear 155 rotates as well. Gear 155 is in constant mesh with the eject roller gear 115 so as to cause rotation of the eject roller 113. This completes a series of interconnecting gears from the drive motor 65 to the eject roller 113 commonly referred to as an eject roller gear train. Therefore, the drive motor 65 causes rotation of the eject roller 113 at a desired speed which may be different than that for the print roller 107 by way of the eject roller gear train.

It should now be apparent to those skilled in the art that the drive motor 65 actuates both the print roller 107 and the eject roller 113 by way of the print roller gear train and the eject roller gear train, respectively. Clockwise rotation of the print roller 107 and eject roller 113 cause the envelope 25 to move from left to right as indicated by arrow "A." Additionally, the print roller gear train and the eject roller gear train share as common components: drive motor output gear 121, idler gear 123, first drive shaft gear 125, and second drive shaft gear 127. Accordingly, gear 133, gear 153, gear 155 and the eject roller gear 115 are unique to the eject roller gear train. Similarly, gear 135, gear 139, gear 141 and the print roller gear 109 are unique to the print roller gear train. The print roller gear train and the eject roller gear train have been designed such that: (1) the print roller and the eject roller always rotate in the same direction, and (2) the eject roller rotates approximately 8 times faster than the print roller. This has the effect of increasing the throughput of the meter by ejecting the envelope 25 quickly once printing is completed. Those skilled in the art will appreciate that the print roller gear train and the eject roller gear train may be designed to accommodate virtually any desired difference in speed between the rotation of the print roller 107 and the eject roll 113.

The drive assembly 33 also includes a cover (not shown for the sake of clarity). The cover is detachably mounted to the housing 101 but contains openings for the print roller 107 and eject roller 113. The cover contains a top surface located between the print roller 107 and eject roller 113 which is aligned with the deck 15 when the housing 101 is in the home position. This surface provides a more continuous area for the envelope 25 to contact and guides the leading edge 24 so that it does not get caught in the drive assembly. This ensures that the envelope 25 feeds properly through the meter 11. Another function of the cover is to protect the components internal to the housing from dust and other contaminants. A further function of the cover is to assist in retaining the various gears rotatively mounted to the housing 101. Other features and functions of the cover will be readily apparent to those skilled in the art.

Referring to FIGS. 4 and 5A, the drive assembly 33 further includes a thickness compensating mechanism. Generally located inside the drive housing 103 and rotatively mounted to the drive shaft 101 between the first drive shaft gear 125 and the second drive shaft gear 127 are the following components: a print torsion spring 245, a print lever 241, an eject lever 281, and an eject torsion spring 285. The eject lever 281 and the print lever 241 are adjacent to each other and generally centrally located on the drive shaft 101 between the first drive shaft gear 125 and the second drive shaft gear 127. The print lever 241 contains an outward extending ridge 242 while the eject lever 281 contains a similar outward extending ridge 282. The purpose of ridges 242 and 282 is to prevent print lever 241 and eject lever 281 from rotating past each other. Ridge 242 contacts eject lever 281 to prevent rotation of print lever 241 in a counter clockwise direction but allow rotation of print lever 241 in a clockwise direction. Similarly, ridge 282 contacts print lever 241 to prevent rotation of eject lever 281 in a clockwise direction but allow rotation of eject lever 281 in a counter clockwise direction. Next to the print lever 241 is the print torsion spring 245. Similarly, the eject torsion spring 285 is next to the eject lever 281. The print torsion spring 245 includes a first straight end portion 247 which is fixably mounted to a print spring clip 253 located in the drive housing 103. The print torsion spring 245 also contains a second straight end portion 249 which bears against the bottom of print torsion spring slot 251 located in the drive housing 103. A print lever stud 243 extending outward from the print lever 241 is spaced slightly apart from the second straight end portion 249. To allow for additional compression of the print torsion spring 245, the second straight end portion 249 is free to move within the print torsion spring slot 251. The eject torsion spring 285 also includes a first straight end portion 287 and a second straight end portion 289. Similarly, the first straight end portion 287 is fixably mounted to an eject spring clip 293 located in the drive housing 103 while the second straight end portion 289 of the eject torsion spring 285 bears against the bottom of eject torsion spring slot 281 located in the drive housing 103. An eject lever stud 283 extending outward from the eject lever 281 is spaced slightly apart from the second straight end portion 289. To allow for additional compression of the eject torsion spring 285, the second straight end portion 289 is free to move within the eject torsion spring slot 291.

Referring to FIGS. 5B and 5C, it should now be understood that in the print position, the print torsion spring 245 supplies a force biasing the print roller 107 toward the thermal print head 19. Similarly, in the eject position, the eject torsion spring 285 supplies a force biasing the eject roller 113 toward the backing roller 31. It should be appreciated that a greater biasing force is needed to ensure quality printing than for ejecting the envelope from the meter. Therefore, the spring rate for the print torsion spring 245 is greater than that for the eject torsion spring 285.

Referring to FIGS. 2 and 3, the leading edge sensor 29 and the trailing edge sensor 27 are suitably positioned relative to the deck 15 so as to detect the presence of the envelope 25. The leading edge sensor 29 is positioned downstream in the direction of envelope travel "A" from the print roller 107 but upstream from the drive shaft 101. The leading edge sensor 29 indicates to the microcontroller the presence of the envelope 25 when a leading edge 24 of the envelope 25 blocks the leading edge sensor 29. The trailing edge sensor 27 is positioned upstream from the print roller 107. The trailing edge sensor 27 indicates to the microcontroller 53 when a trailing edge 26 of the envelope 25 is detected.

Figure 6:
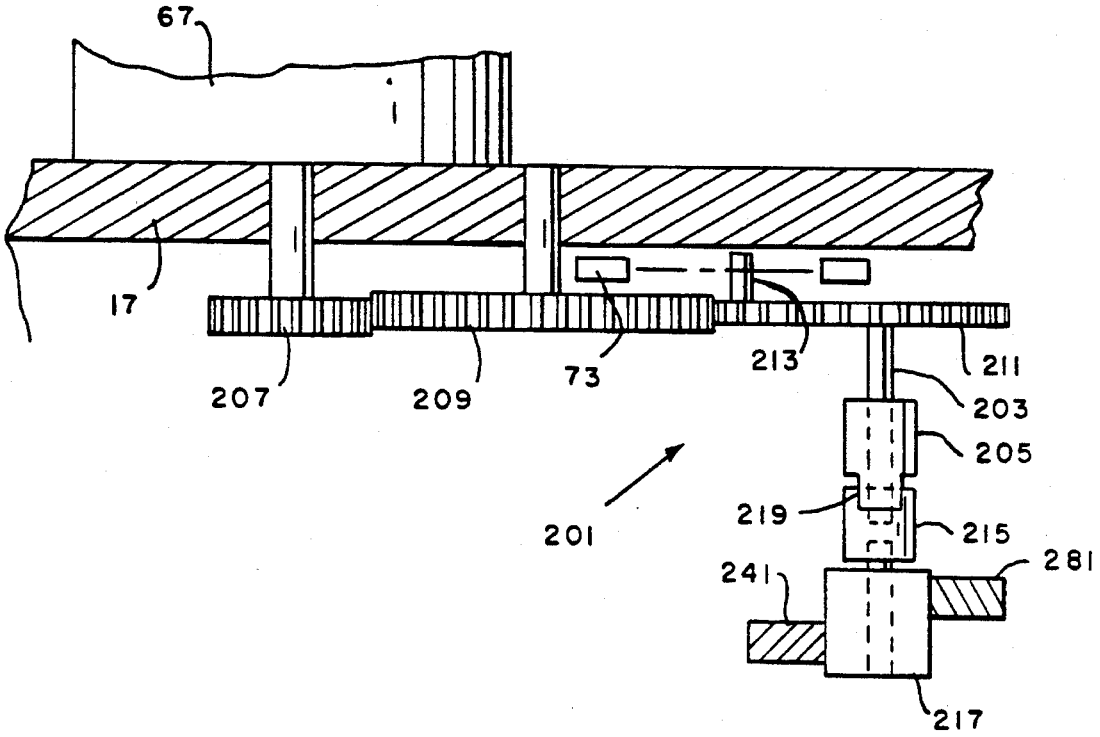
FIG. 6 is a sectioned top view of the crank assembly for repositioning the drive assembly.

Referring to FIGS. 5A and 6, a crank assembly 201 is also generally located in the deck recess 23. The crank assembly 201 is in driving engagement with the drive assembly 33 for repositioning the drive assembly 33 between the home, print and eject positions. Generally located parallel to and vertically aligned below the drive shaft 101 is a crank shaft 203. The crank shaft 203 is rotatively mounted in a needle bearing (not shown) in a crank shaft support post 205 which is fixably mounted to wall 23*d* of the deck recess 23. The crank shaft support post 205 is located generally central along the axis of the crank shaft 203 such that both ends of the crank shaft are cantilevered out from the post 205. Fixably mounted to the output shaft of the crank motor 67 is a crank motor output gear 207. The crank motor output gear 207 is in constant mesh with an idler gear 209 which is rotatively mounted to the registration wall 17. Fixably mounted to one end of the crank shaft 203 is a crank shaft gear 211. The crank shaft gear 211 is in constant mesh with the idler gear 209. Extending outward from the crank shaft gear 211 is a crank shaft gear flag 213 such that it may be detected by the home position sensor 73 during rotation of the crank shaft gear 211. When the home position sensor 73 detects the crank shaft gear flag 213 the microcontroller recognizes that the drive assembly 33 is in the home position. Fixably mounted to the other end of the crank shaft 203 is one end of a crank arm 215. Extending outward from the crank shaft support post 205 is a crank arm stop 219 for limiting the amount of travel of the crank arm 215. The crank arm stop 219 prevents rotation of the crank arm 215 beyond 130 degrees in either the clockwise or counter clockwise direction from the home position. Rotatably mounted to the other end of the crank arm 215 is a crank roller 217. The crank roller 217 is spaced slightly apart from the print lever 241 and the eject lever 281 so that depending on the direction of rotation of the crank arm, the crank roller 217 actuates either the print lever 241 or the eject lever 281.

Referring to FIG. 5B, to reposition the drive housing from the home position to the print position, the crank motor 67 rotates in a clockwise direction which causes the crank shaft 203 to also rotate in the clockwise direction by way of the crank motor gear 207, idler gear 209 and crank shaft gear 211. As a result, the crank roller 217 bears on the print lever 241 while the print lever stud 243 engages the second straight end portion 249 of the print torsion spring 245 causing the drive housing 103 to rotate clockwise about the drive shaft. As the drive housing 103 rotates clockwise, the print roller 107 lifts the envelope 25 from the deck 15 toward the thermal print head 19. Depending on the thickness of the envelope 25, the envelope 25 will contact the thermal print head 19 at different points along the rotation of the drive housing 103. Once the envelope 25 comes into contact with the thermal print head 19, further rotation of the drive housing 103 causes the envelope 25 to be compressed between the print roller 107 and the thermal print head 19. During compression of the envelope 25, the forces between the print roller 107 and the thermal print head 19 increase until the forces equal the spring force of the print torsion spring 245. At this point, further rotation of the crank arm 215 does not cause further rotation of the print roller 107, but instead causes compression of the print torsion spring 245. Compression occurs because the crank arm 215 continues to rotate causing the crank roller 217 to bear against the print lever 241 containing the print lever stud 243 which in turn causes the second straight end portion 249 of the print torsion spring 245 to lift off the bottom of slot 251 and rotate about the axis of the print torsion spring 245 while the first straight end portion 247 of the print torsion spring 245 remains stationary. Therefore, it is now apparent that the print torsion spring 245 compensates for different thicknesses of the envelope 25 and supplies appropriate backing pressure to yield quality printing without damaging the thermal print head 19. The print torsion spring 245 is compressed to a different extent depending on the thickness of envelope 25. Because this variable amount of compression is small compared to the pre-load of the print torsion spring 245, the thermal print head 19 receives relatively constant force regardless of the thickness of the envelope 25.

During the first 110 degrees of rotation of the crank arm 215 from the home to the print position, compression of the print torsion spring 245 supplies a force tending to rotate the crank arm 215 in the counter clockwise direction. This is opposed to the efforts of the crank motor 67 which is rotating the crank arm 215 in a clockwise direction. But once the crank arm 215 rotates past 110 degrees, compression of the print torsion spring 245 supplies a force tending to rotate the crank arm 215 in the clockwise direction. Therefore, in the first 110 degrees of rotation of the crank arm 215, the print torsion spring 245 opposes the efforts of the crank motor 67 while from 110 degrees to 130 degrees the print torsion spring 245 assists the crank motor 67 in rotating the crank arm 215 in a clockwise direction. When the crank arm 215 has rotated 130 degrees, it contacts the crank arm stop 219 which is fixably attached to the crank shaft support post 205 and is prevented from rotating further. Therefore, the print torsion spring 245 retains the drive assembly 33 in the print position by holding the crank arm 215 against the crank arm stop 219. As a result, the crank motor 67 does not need to operate to maintain the drive housing 103 in the print position. To return the drive assembly 33 to the home position, the crank motor 67 rotates in the counter clockwise direction until the crank gear flag 213 is detected by the home position sensor 73 at which point the microcontroller 53 turns off the crank motor 67.

Referring to FIG. 5C, the crank assembly 201 operates in analogous fashion to reposition the drive housing 103 from the home position to the eject position. The crank motor 67 rotates in a counter clockwise direction which causes the crank shaft 203 to also rotate in a counter clockwise direction. As a result, the crank roller 217 bears on the eject lever 281 while the eject lever stud 283 engages the second straight end portion 289 or eject torsion spring 285 causing the drive housing 103 to rotate counter clockwise about the drive shaft 101. As the drive housing 103 rotates counter clockwise, the eject roller 113 lifts the envelope 25 from the deck 15 toward the backing roller 31. Depending on the thickness of the envelope 25, the envelope 25 will contact the backing roller 31 at different points along the rotation of the drive housing 103. Once the envelope 25 comes into contact with the backing roller 31, further rotation of the drive housing 103 causes the eject roller 113 to compress the envelope 25 against the backing roller 31. During compression of the envelope 25, the forces between the eject roller 113 and the backing roller 31 increase until the forces equal the spring force of the eject torsion spring 285. At this point, further rotation of the crank arm 215 does not cause further rotation of the eject roller 113, but instead causes compression of the eject torsion spring 285. Compression occurs because the crank arm 215 continues to rotate causing the crank roller 217 to bear against the eject lever 281 containing the eject lever stud 283 which in turn causes the second straight end portion 289 of the eject torsion spring 285 to lift off the bottom of slot 291 and rotate about the axis of the eject torsion spring 285 while the first straight end portion 287 of the eject torsion spring 285 remains stationary. To allow for compression of the eject torsion spring 285, drive housing 103 contains slot 291. Therefore, it is now apparent that the eject torsion spring 285 compensates for different thicknesses of the envelope 25 and supplies appropriate force to feed the envelope 25 from the postage meter 11 without crushing the envelope 25.

During the first 110 degrees of rotation of the crank arm 215 from the home to the eject position, compression of the eject torsion spring 285 supplies a force tending to rotate the crank arm 215 in the clockwise direction. This is opposed to the efforts of the crank motor 67 which is turning the crank arm 215 in the counter clockwise direction. But once the crank arm 215 rotates past 110 degrees, compression of the eject torsion spring 285 supplies a force tending to rotate the crank arm 215 in the counter clockwise direction. Therefore, in the first 110 degrees of rotation of the crank arm 215, the eject torsion spring 285 opposes the efforts of the crank motor 67 while from 110 degrees to 130 degrees the eject torsion spring 285 assists the crank motor 67 in rotating the crank arm 215 in a counter clockwise direction. When the crank arm 215 has rotated 130 degrees, it contacts the crank arm stop 219 which is fixably attached to the crank shaft support post 205 and is prevented from rotating further. Therefore, the eject torsion spring 285 retains the drive assembly 33 in the eject position by holding the crank arm 215 against the crank arm stop 219. As a result, the crank motor 67 does not need to operate to maintain the drive housing in the eject position. To return the drive assembly 33 to the home position, the crank motor 67 rotates in the clockwise direction until the crank gear flag 213 is detected by the home position 73 sensor at which point the microcontroller 53 turns off the crank motor 67.

It should now be apparent that the crank motor 67 does not need to operate in the home, print or eject positions. The crank motor 67 is only required to operate when pivoting the drive assembly 33 between these positions. Also, when compressing the envelope 25 in the print position or the eject position, the print torsion spring 245 and the eject torsion spring 285, respectively, assist the crank motor 67. This has the overall effect of reducing the torque requirements on motor 67 over the prior art system which uses an inefficient eccentric cam based system to reposition the print roller link 501 and eject roller link 503.

The thermal postage meter 11 remains at idle with the drive assembly 33 and the crank assembly 201 in the home position until the operator advances the envelope 25 sufficiently along the deck 15 so that the leading edge 24 of envelope 25 is detected by the leading edge sensor 29. Once the leading edge 24 of the envelope 25 is detected, the programmable microcontroller 53 initiates a print cycle. The microcontroller 53 initiates and manages all operations performed on the envelope 25 by the thermal print head 19, drive assembly 33 and crank assembly 201. First, the microcontroller 53 signals the crank motor 67 to rotate in a clockwise direction to pivot the drive housing 101 to the print position. It is now apparent that the leading edge sensor 29 is suitably positioned downstream from the print roller 107 to ensure that the envelope 25 is property captured between the print roller 107 and the thermal print head 19 when the drive housing 103 rotates to the print position. Once the drive housing 103 reaches the print position, the crank motor 67 is turned off. As discussed above, the drive housing 103 will remain in the print position without the assistance of the crank motor 67. The spring rate of the print torsion spring 245 has been designed sufficiently high to provide for quality printing but not so high as to damage the thermal print head 19. Next, the drive motor 65 is turned on. The drive motor 65 causes the print roller 107 to rotate and thereby advance the envelope 25 and thermal ribbon TR past the print head 19 to produce the postal indicia or desired image on the envelope 25. Upon completion of the printing, the drive motor 65 is turned off and the crank motor 67 is instructed to rotate in a counter clockwise direction to pivot the drive housing 103 from the print position back through the home position and into the eject position. Once the drive housing 103 reaches the eject position, the crank motor 67 is turned off. As discussed above, the drive housing 103 will remain in the eject position without the assistance of the crank motor 67. The spring rate of the eject torsion spring 285 has been designed sufficiently high to provide for proper feeding of the envelope 25 from the postage meter 11 but no so high as to smudge the just printed indicia or damage the envelope 25 or the backing roller 31. Next, the drive motor 65 is turned on again. The drive motor 65 causes the eject roller 113 to begin to feed the envelope 25 out of the thermal postage meter 11. When the trailing edge sensor 27 detects the trailing edge 26 of envelope 25, the drive motor 65 continues to rotate the eject roller 113 for a predetermined amount of time to ensure that the envelope 25 is properly feed out to the thermal postage meter 11. For increased throughput, the eject roller 113 rotates approximately 8 times faster than the print roller 107.

Many features of the preferred embodiment represent design choices selected to best exploit the inventive concept for as implemented in a thermal postage meter. For example, without difficulty those skilled in the art could substitute a system of belts and pulleys for the various gear trains described above or replace backing roller 31 with a stationary skid plate. However, the present invention is applicable to any thermal printer. Moreover, additional advantages and modifications will readily occur to those skilled in the art. Therefore, the invention in its broader aspects is not limited to the specific details of the preferred embodiment. Accordingly, various modifications may be made without departing from the spirit of the general inventive concept as defined by the appended claims and their equivalents.

What is claimed is:

1. A thermal printing apparatus having a frame for supporting a thermal print head opposite to a first roller to define a print station for printing on an article, comprising:

a drive shaft rotatively mounted to said frame, sensing means for detecting the presence of said article in said print station, a second roller downstream in the direction of article travel from said first roller, drive means responsive to said sensing means for rotating said first roller and said second roller, backing means opposite to said second roller, a drive housing pivotally mounted to said to said drive shaft for rotatively supporting said first roller and said second roller such that said first roller and said second roller are approximately symmetrical about said drive shaft, crank means for rotating said drive housing between: (i) a first position where said first roller is spaced apart from said print head, (ii) a second position where said first roller presses said article toward said thermal print head, and (iii) a third position where said second roller presses said article toward said backing means, said crank means responsive to said sensing means to rotate said drive housing from said first position to said second position, first roller biasing means operative in said second position for biasing said drive housing towards said thermal print head, said first roller biasing means including;

a first torsion spring having a first end and a second end, said first torsion spring rotatively mounted to said drive shaft, said first end fixably mounted to said drive housing, and a first lever arm rotatively mounted to said drive shaft, said second end of said first torsion spring fixably mounted to said first lever arm, and second roller biasing means operative in said third position for biasing said drive housing towards said backing means.

2. A printer according to claim 1 wherein said second roller biasing means includes:

a second torsion spring having a first end and a second end, said second torsion spring rotatively mounted to said drive shaft, said first end fixably mounted to said drive housing, and a second lever arm rotatively mounted to said drive shaft, said second end fixably mounted to said second lever arm.

3. A printer according to claim 2 wherein said crank means operatively engages said first lever arm to rotate said drive housing from said first position to said second position and wherein said first torsion spring compresses as said article is biased against said thermal print head.

4. A printer according to claim 3 wherein said crank means operatively engages said second lever arm to rotate said drive housing to said third position and wherein said second torsion spring compresses as said article is biased against said backing means.

5. A printer according to claim 4 wherein said drive means includes a motor and a gear train operatively coupling said motor to said first roller and said second roller so that said second roller rotates faster than said roller.

6. A printer according to claim 1 wherein said crank means operatively engages said first lever arm to rotate said drive housing from said first position to said second position and wherein said first torsion spring compresses as said article is biased against said thermal print head.

7. A printer according to claim 6 wherein said drive means includes a motor and a gear train operatively coupling said motor to said first roller and said second roller so that said second roller rotates faster than said first roller.

* * * * *